US008835787B2

(12) United States Patent
Takeuchi et al.

(10) Patent No.: US 8,835,787 B2
(45) Date of Patent: Sep. 16, 2014

(54) PUSH SWITCH

(75) Inventors: Masatsugu Takeuchi, Okayama (JP); Yutaro Nakagawa, Okayama (JP)

(73) Assignee: Panasonic Corporation, Osaka (JP)

( * ) Notice: Subject to any disclaimer, the term of this patent is extended or adjusted under 35 U.S.C. 154(b) by 154 days.

(21) Appl. No.: 13/598,923

(22) Filed: Aug. 30, 2012

(65) Prior Publication Data

US 2013/0062170 A1 Mar. 14, 2013

(30) Foreign Application Priority Data

Sep. 8, 2011 (JP) ..... 2011-195825

(51) Int. Cl.

| | |
|---|---|
| ***H01H 1/10*** | (2006.01) |
| ***H01H 13/06*** | (2006.01) |
| *H01H 13/52* | (2006.01) |
| *H01H 13/10* | (2006.01) |

(52) U.S. Cl.

CPC ..... *H01H 13/06* (2013.01); *H01H 2205/016* (2013.01); *H01H 13/52* (2013.01); *H01H 2221/024* (2013.01); *H01H 2223/044* (2013.01); *H01H 2215/004* (2013.01); *H01H 2227/026* (2013.01); *H01H 13/10* (2013.01); *H01H 2229/02* (2013.01)

USPC ..... 200/516

(58) Field of Classification Search

USPC ..... 200/406

See application file for complete search history.

(56) References Cited

U.S. PATENT DOCUMENTS

| | | | | |
|---|---|---|---|---|
| 4,343,973 | A * | 8/1982 | Main | 200/516 |
| 4,843,197 | A * | 6/1989 | Kojima et al. | 200/406 |
| 2011/0108401 | A1 | 5/2011 | Yamada et al. | |

FOREIGN PATENT DOCUMENTS

| | | |
|---|---|---|
| CN | 1928782 | 3/2007 |
| CN | 102099885 | 6/2011 |
| JP | 2000-294079 | 10/2000 |
| JP | 2006-236805 | 9/2006 |
| JP | 2006-344511 | 12/2006 |
| JP | 2010-021034 | 1/2010 |

OTHER PUBLICATIONS

English Translation of Chinese Search Report issued on Jun. 4, 2014 for the related Chinese Patent Application No. 201210328277.8.

* cited by examiner

*Primary Examiner* — Renee Luebke
*Assistant Examiner* — Lheiren Mae A Caroc
(74) *Attorney, Agent, or Firm* — Panasonic Patent Center

(57) ABSTRACT

A push switch includes a switch contact part for carrying out electrical connection by pressing, a case having a wall part on a periphery thereof and accommodating the switch contact part in a concave portion surrounded by the wall part, and a protective sheet covering the concave portion. The protective sheet and at least a part of an upper surface of the wall part of the case are welded together as a first welding place.

10 Claims, 6 Drawing Sheets

PUSH SWITCH

BACKGROUND OF THE INVENTION

1. Field of the Invention

The present invention relates to a push switch used in input operation units of electronic apparatuses.

2. Background Art

As a switch for a signal of an input operation unit of an electronic apparatus, a push switch in which a movable contact operates with a click feeling by pressing is used. FIG. 7 is a sectional view of a conventional push switch. FIG. 8 is an external perspective view of the conventional push switch. FIG. 9 is an exploded perspective view of the conventional push switch. Case 1 is formed in a box shape having an opening at the upper surface and has a concave portion. Case 1 is formed of an insulating resin. Center contact 2 and outer contacts 3 are fixed to the inner bottom surface of the concave portion of case 1. Terminal 2A coupled to center contact 2 and terminal 3A coupled to outer contact 3 are extended toward the outside of case 1, respectively.

Movable contact 4 is formed of an elastic thin metal plate and formed in an upwardly convex dome shape. The lower end of the outer periphery of movable contact 4 is placed on outer contacts 3. Movable contact 4 is disposed in the concave portion. A lower surface of a top of the dome shape of movable contact 4 and center contact 2 face each other with a space therebetween.

Protective sheet 5 is an insulating film. Adhesive layer 5A is formed on the entire surface of the lower surface of protective sheet 5. Case 1 has wall part 1A on the periphery thereof. Protective sheet 5 is adhesively held on the upper surface of wall part 1A by adhesive layer 5A so as to cover the concave portion of case 1.

Next, an operation of a conventional push switch is described. A pressing force is applied to the top of the dome shape of movable contact 4 from the upper side via protective sheet 5. When the pressing force exceeds a predetermined force, the center portion of the dome shape is elastically reversed in a downwardly convex shape with a click feeling, so that the lower surface of the center portion of movable contact 4 is brought into contact with center contact 2. Thus, center contact 2 and outer contacts 3 are electrically conducting with each other via movable contact 4, so that a switch is turned on.

Then, when the applied pressing force is removed, the center portion of the dome shape of movable contact 4 elastically returns to an original upwardly convex shape with a click feeling. As a result, the center portion of movable contact 4 is apart from center contact 2, so that center contact 2 and outer contacts 3 are insulated from each other. Thus, a switch is returned to an OFF state.

SUMMARY OF THE INVENTION

A push switch of the present invention includes a switch contact part for carrying out electrical connection by pressing; a case having a wall part on a periphery thereof and accommodating the switch contact part in a concave portion surrounded by the wall part; and a protective sheet covering the concave portion. The protective sheet and at least a part of an upper surface of the wall part of the case are welded together as a first welding place.

DETAILED DESCRIPTION OF THE INVENTION

Figure 7:
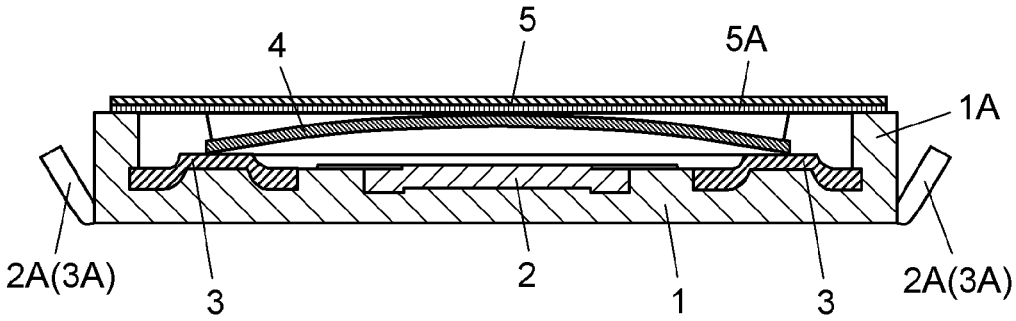
FIG. 7 PRIOR ART
FIG. 7 is a sectional view of a conventional push switch.
Figure 8:
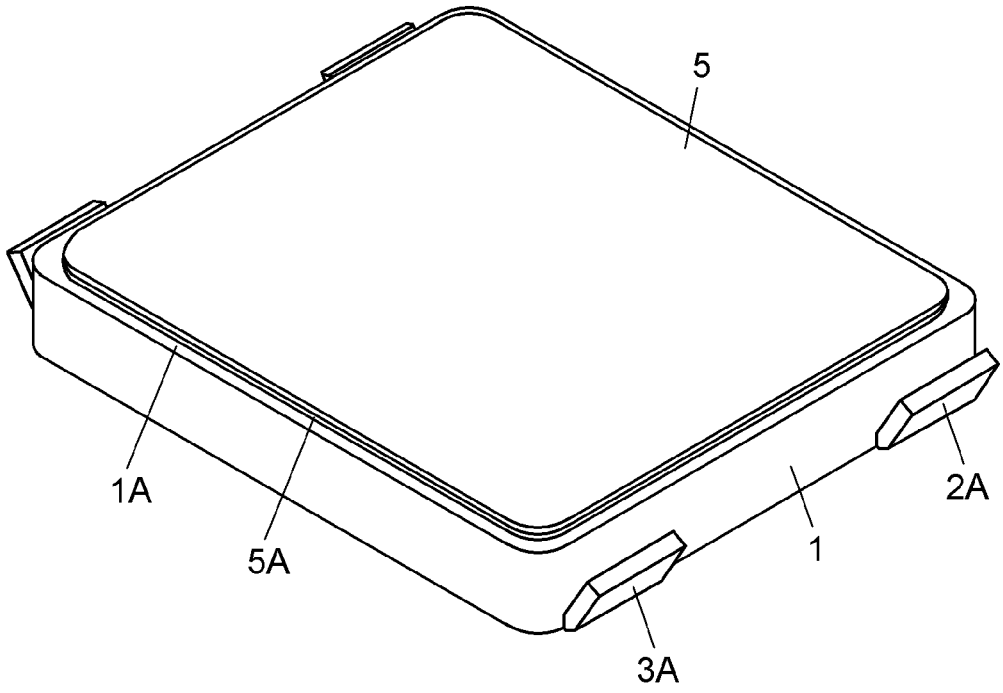
FIG. 8 PRIOR ART
FIG. 8 is an external perspective view of the conventional push switch.
Figure 9:
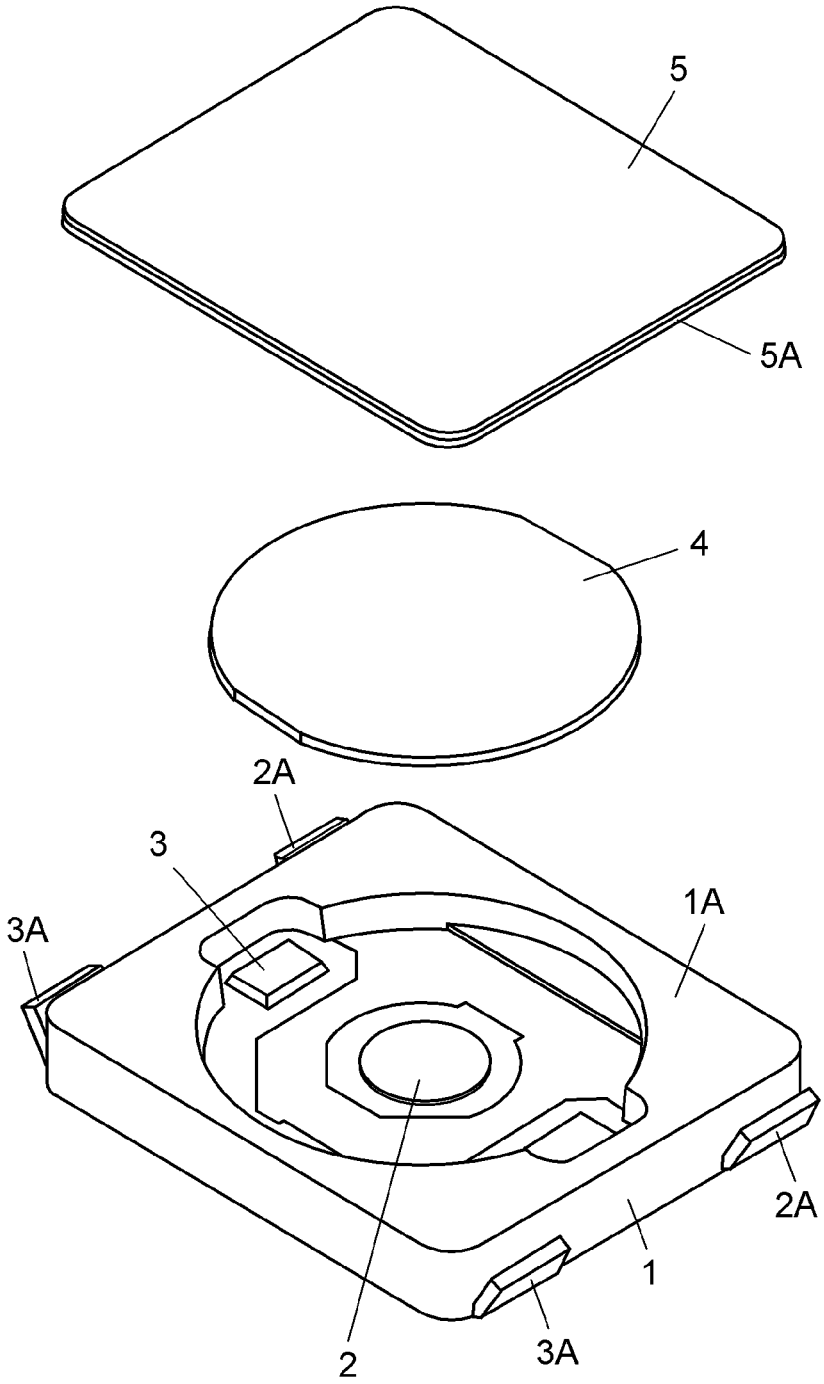
FIG. 9 PRIOR ART
FIG. 9 is an exploded perspective view of the conventional push switch.

Recently, electronic apparatuses have been reduced in size and weight. Accordingly, electronic components loaded on such electronic apparatuses have been also desired to be reduced in size. In a conventional push switch, as shown in FIGS. 7 to 9, protective sheet 5 is held on an upper surface of wall part 1A of case 1 by adhesive layer 5A. Therefore, when the size becomes small, an area in which adhesive layer 5A of protective sheet 5 and the upper surface of wall part 1A of case 1 are brought into contact with each other is reduced. As a result, it becomes difficult to stably hold protective sheet 5 on case 1.

Figure 1:
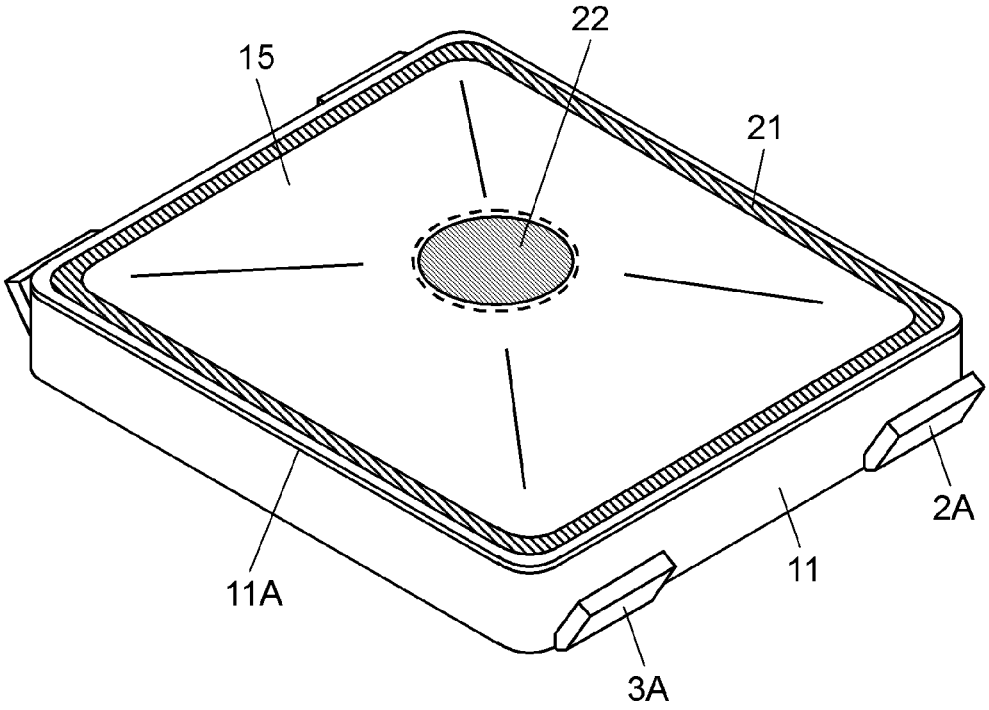
FIG. 1 is an external perspective view of a push switch in accordance with an embodiment of the present invention.
Figure 2:
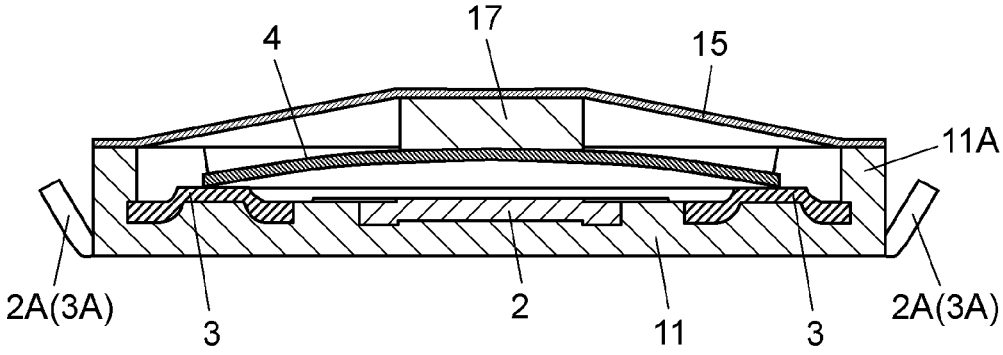
FIG. 2 is a sectional view of the push switch in accordance with the embodiment of the present invention.
Figure 3:
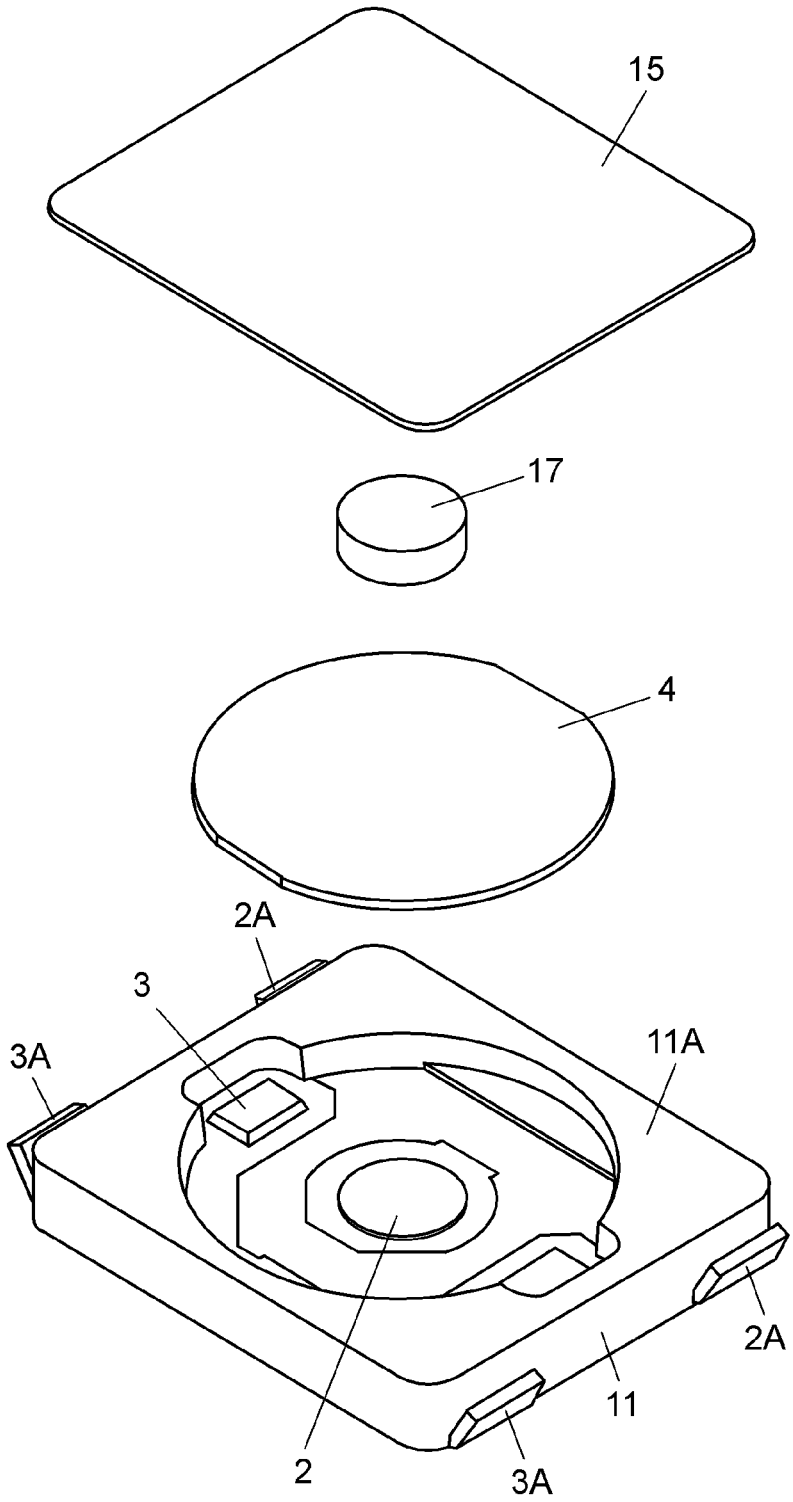
FIG. 3 is an exploded perspective view of the push switch in accordance with the embodiment of the present invention.
Figure 4A:
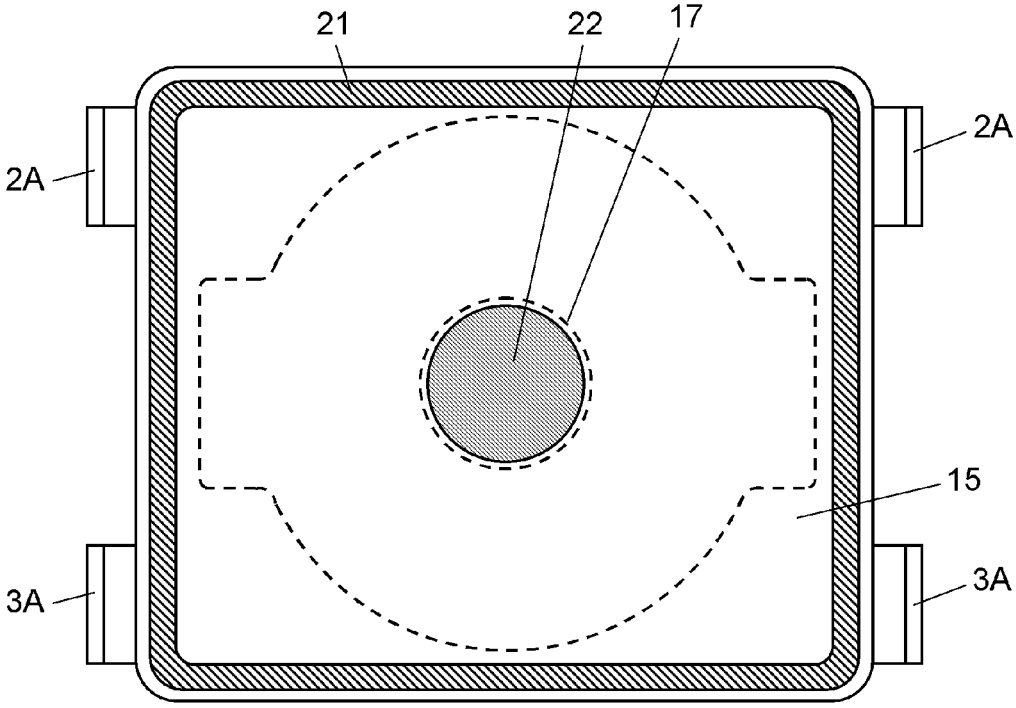
FIG. 4A is a top view of the push switch in accordance with the embodiment of the present invention.
Figure 4B:
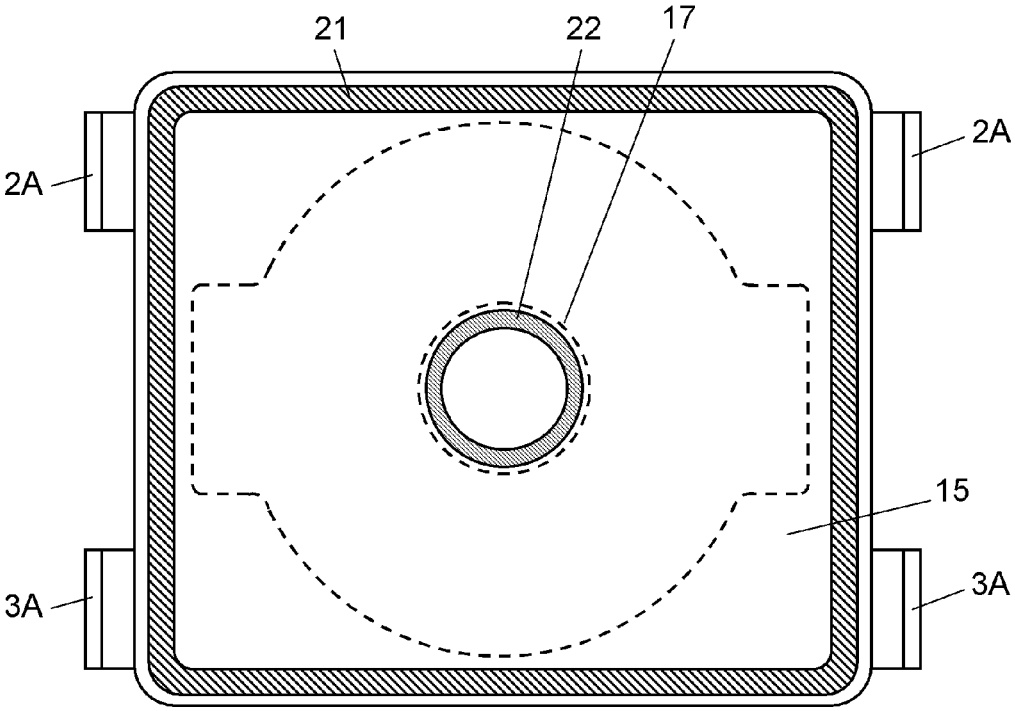
FIG. 4B is a top view of another push switch in accordance with the embodiment of the present invention.

Hereinafter, a push switch of the present invention is described with reference to FIGS. 1 to 6. FIG. 1 is an external perspective view of a push switch in accordance with an embodiment of the present invention. FIG. 2 is a sectional view of the push switch in accordance with the embodiment of the present invention. FIG. 3 is an exploded perspective view of the push switch in accordance with the embodiment of the present invention. FIG. 4A is a top view of the push switch in accordance with the embodiment of the present invention. FIG. 4B is a top view of another push switch in accordance with the embodiment of the present invention.

The push switch includes center contact 2, outer contacts 3, and movable contact 4, which are electrically connected to each other by pressing. Center contact 2, outer contacts 3, and movable contact 4 constitute a switch contact part. The push switch further includes case 11 having wall part 11A on a periphery thereof and accommodating the switch contact part in a concave portion surrounded by wall part 11A, and protective sheet 15 covering the concave portion. Protective sheet 15 and at least a part of an upper surface of wall part 11A of case 11 are welded together by linear first welding place 21 provided between an edge portion of protective sheet 15 and the upper surface.

Case 11 is formed in a box shape that is opened at the upper surface, and has a concave portion surrounded by wall part 11A. Case 11 is formed of an insulating resin. Metallic center contact 2 and metallic outer contacts 3 are fixed to an inner bottom surface of the concave portion by insert molding of resin that forms case 11. Terminal 2A coupled to center contact 2 and terminal 3A coupled to outer contact 3 are extended toward the outside of case 11, respectively.

Movable contact 4 is formed of an elastic thin metal plate, and formed in an upwardly convex dome shape. The lower end of the outer periphery of movable contact 4 is placed on outer contact 3, and movable contact 4 is disposed in the concave portion. The lower surface of the center part of the dome shape of movable contact 4 and center contact 2 face each other with a space therebetween. The switch contact part including center contact 2, outer contacts 3 and movable contact 4 is contained in the concave portion of case 11.

Protective sheet 15 is formed of an insulating film, and disposed on case 11 so as to cover the concave portion. The edge portion of protective sheet 15 is mounted on the upper surface of wall part 11A of case 11. In this embodiment, protective sheet 15 is welded to case 11 by laser irradiation. Note here that a place on which protective sheet 15 is fixed by welding has a linear shape having a predetermined width, and it is shown as first welding place 21 by hatching in FIGS. 1, 4A and 4B.

Pressing member 17 formed of an insulating resin is stuck to the lower surface of protective sheet 15. The lower surface of pressing member 17 is put on a top of the center of movable contact 4. In this embodiment, columnar pressing member 17 is used. However, the shape is not limited to this, and the shape may be a prismatic shape or a semi-spherical shape. Also protective sheet 15 and pressing member 17 may be welded to each other by laser irradiation.

The center portion of protective sheet 15 protrudes upwardly along the shape of the upper surface of pressing member 17, and the protruding upper surface is an operation place. It is preferable that the operation place has a flat surface or a smooth spherical surface. Protective sheet 15 inclines from the operation place to the edge portion. Protective sheet 15 may have a configuration in which a place corresponding to pressing member 17 is embossed such that it protrudes upwardly and the pressing member is contained.

In order to allow protective sheet 15 and case 11 to be welded by laser irradiation, case 11 having a material property and a color tone capable of absorbing laser is used, and protective sheet 15 having a material property and a color tone having high transmittance with respect to laser is used. For example, case 11 is formed of resin such as nylon and PPS (Polyphenylene Sulfide). For protective sheet 15, an insulating film that does not have an adhesive layer on the lower surface is used. Since protective sheet 15 and case 11 are welded by laser irradiation, they have preferably the same material or material property, but they are at least required to have near melting points and be mixed with each other when they are melted. Then, a relation between a raw material of protective sheet 15 and a raw material of case 11 mentioned above is the same as a relation between a raw material of protective sheet 15 and a raw material of pressing member 17.

The outer shape of protective sheet 15 seen from the upper surface is a rectangular shape that is substantially the same as the outer shape of case 11. First welding place 21 is a place in which the edge portion of protective sheet 15 and the upper surface of wall part 11A of case 11 are welded to each other. First welding place 21 is formed along the outer periphery of the upper surface of wall part 11A. That is to say, first welding place 21 has a closed linear rectangular shape as shown in FIG. 4A seen from the upper surface of protective sheet 15. The outer periphery of the concave portion is surrounded by first welding place 21, so that a dust-proof property or a drip-proof property can be secured. When first welding place 21 is provided along the outer edge of protective sheet 15, floating or rolling-up from the outer edge side of protective sheet 15 can be prevented. Furthermore, pressing member 17 can be located easily.

Next, a method for manufacturing the push switch in this embodiment is described. Firstly, movable contact 4 provided with pressing member 17 in which pressing member 17 is provisionally fixed to the upper surface of the center part of movable contact 4 is disposed in the concave portion of case 11, which is defined as a first product in process. The first product in process and protective sheet 15 are prepared. Note here that the provisional fixing of movable contact 4 and pressing member 17 is preferably carried out with an adhesive agent having large flexibility (not shown), but the provisional fixing is not particularly limited to this. Furthermore, a long protective sheet before being processed into individual protective sheets 15 may be used.

Then, with respect to the first product in process, the edge portion of protective sheet 15 is put on the upper surface of wall part 11A of case 11 so that the upper side of the concave portion of case 11 is covered with protective sheet 15.

Next, laser irradiation is carried out from the upper side of protective sheet 15. Thus, the edge portion of protective sheet 15 and the upper surface of wall part 11A of case 11 are linearly welded to each other so as to form first welding place 21. Furthermore, the upper surface of pressing member 17 is welded to the lower surface of protective sheet 15 so as to form second welding place 22. Note here that welding of first welding place 21 and welding of second welding place 22 may be carried out simultaneously, or may be carried out separately sequentially. Herein, second welding place 22 is not limited to a circular shape, but it may be a ring shape as shown in FIG. 4B, or may be a cross shape or a linear shape.

Herein, a welding state is briefly described with first welding place 21 as an example. When laser irradiation is carried out, laser passes through protective sheet 15 as an irradiated place, the upper surface of wall part 11A positioned below is melted. At the same time, the lower surface of protective sheet 15, which has been irradiated with laser, is also melted, and the interface portions between the upper surface of wall part 11A and the lower surface of protective sheet 15 are mixed and welded with each other.

First welding places 21 may be sequentially provided linearly so that they form a rectangular outer shape seen from the upper surface of protective sheet 15. Alternatively, first welding place 21 may be welded by laser irradiation at one time by setting a mask on protective sheet 15. Note here that in order to efficiently provide first welding place 21 by laser irradiation, it is preferable that laser irradiation is carried out in a state in which the lower surface of the edge portion of protective sheet 15 is brought into contact with or pressed into contact with the upper surface position of wall part 11A of case 11. However, means for bringing or pressing the lower surface of the edge portion of protective sheet 15 into contact with the upper surface position of wall part 11A of case 11 is not particularly limited.

It is preferable that linear first welding place 21 has a line width of not more than 0.1 mm and not less than 0.2 mm. Furthermore, it is preferable that linear first welding place 21 is provided at the outer side from the inner periphery of wall part 11A by about 0.03 mm or more because the degree of effect on the switch contact part in the concave portion can be suppressed when laser welding is carried out.

Furthermore, it is preferable also in the case where pressing member 17 is interposed that welding place 21 is formed linearly along the outer periphery of the upper surface of wall part 11A because a place in which protective sheet 15 bends can be increased.

Furthermore, it is preferable that second welding place 22 is allowed to fall in the range of the upper part of pressing member 17 because the effect of laser welding on the switch contact part can be reduced. Note here that since pressing member 17 is provisionally fixed to movable contact 4, pressing member 17 can be easily disposed on movable contact 4 with high accuracy. Furthermore, it is preferable that pressing member 17 is provisionally fixed to movable contact 4 because protective sheet 15 only needs to be put on pressing member 17 and the degree of freedom of disposing protective sheet 15 is increased.

In this way, in this embodiment, the edge portion of protective sheet 15 is welded and held on the upper surface of wall part 11A by linear first welding place 21. Since the welding place is small, an amount of heat generated at the time of welding is suppressed. Consequently, the effect of welding on melted protective sheet 15 and case 11, in addition to the effect on switch contact part, is reduced, thus making it easy to control the push switch.

When protective sheet 15 is welded to case 11 by laser irradiation, even if first welding place 21 has a linear shape, protective sheet 15 and case 11 are held more strongly than by conventional adhesive fixing. In other words, conventionally, when a contact area between protective sheet 15 and case 11 is reduced, protective sheet 15 is not easily held on case 11 stably. However, in this embodiment, even if the contact area between protective sheet 15 and case 11 is small, protective sheet 15 is held on case 11 stably. In addition, since laser irradiation is used, the number of steps of mounting protective sheet 15 on case 11 can be reduced, and a push switch having stable quality can be provided at a low cost.

Next, an operation of the push switch in this embodiment is described. A pressing force is applied to the operation part of protective sheet 15 from the upper side. The pressing force is transmitted to the center part of movable contact 4 via pressing member 17, and the center part of movable contact 4 is pressed by pressing member 17. When the pressing force exceeds a predetermined size, the center portion of movable contact 4 is elastically reversed in a downwardly convex shape with a click feeling. Thus, the lower surface of the center portion of movable contact 4 is brought into contact with center contact 2, so that the switch is turned on. When the pressing force is removed, movable contact 4 elastically returns to its original upwardly convex shape with a click feeling and pushes pressing member 17 back to the original position. As a result, center contact 2 and outer contacts 3 are insulated from each other, and then the switch is returned to an OFF state.

Thus, in this embodiment, since the top position of the center of movable contact 4 is always pressed via pressing member 17, an excellent click feeling can be obtained at the time when an operation is carried out.

When the above-mentioned operation is carried out, protective sheet 15 also bends, and the effect thereof is repeatedly applied to first welding place 21 between case 11 and protective sheet 15. However, since protective sheet 15 is welded and fixed to case 11 at first welding place 21 by laser, the position of protective sheet 15 is not displaced with respect to case 11. Furthermore, since pressing member 17 is also welded and fixed to protective sheet 15 at second welding place 22 by laser, even when pressing member 17 and movable contact 4 become in a state in which they are not provisionally fixed to each other, they can be prevented from being displaced from each other. Therefore, an excellent operation feeling obtained at the time of an operation can be maintained for a long time.

Furthermore, when welding place 21 is formed in a linear shape along the outer periphery of the upper surface of wall part 11A as mentioned above, a place in which protective sheet 15 bends can be increased. Accordingly, it is preferable that the protective sheet 15 easily bends at the time of a pressing operation, so that an effect on the reverse operation of movable contact 4 can be reduced, and thus deterioration of the click feeling is suppressed.

As mentioned above, in the push switch in this embodiment, even if a contact area between protective sheet 15 and case 11 is small, protective sheet 15 can be stably held on case 11. Therefore, the push switch in this embodiment can be easily reduced in size.

In this embodiment, pressing member 17 is provisionally fixed to movable contact 4, but pressing member 17 may be previously stuck to protective sheet 15. Examples of methods of sticking pressing member 17 to protective sheet 15 may include sticking by laser irradiation mentioned above, and adhesively attaching or adhesively fixing of protective sheet 15 to the upper surface of pressing member 17.

Hereinafter, a method for manufacturing a push switch in a state in which pressing member 17 is located on movable contact 4 is described. Firstly, a second product in process in which movable contact 4 is disposed in the concave portion of case 11, and a third product in process in which pressing member 17 is stuck to the lower surface of protective sheet 15 are prepared.

Then, pressing member 17 of the third product in process is put on the center part of movable contact 4 of the second product in process, and at the same time, the edge portion of protective sheet 15 is put on the upper surface of wall part 11A of case 11 such that the concave portion of case 11 is covered with protective sheet 15 of the third product in process.

Next, in this state, irradiation with laser is carried out from the upper side of protective sheet 15, so that protective sheet 15 is welded to the upper surface of wall part 11A of case 11 by linear first welding place 21.

At this time, similar to the above-mentioned manufacturing method, first welding place 21 may be formed sequentially, or may be formed at one time by interposing a mask. Furthermore, as mentioned above, it is preferable that irradiation with laser is carried out in a state in which the lower surface of the edge portion of protective sheet 15 is brought or pressed into contact with the upper surface of wall part 11A of case 11, and means for bringing or pressing the lower surface of the edge portion of protective sheet 15 into contact with the upper surface of wall part 11A of case 11 is not particularly limited.

In a push switch manufactured by the second manufacturing method, since pressing member 17 is just put on movable contact 4, restriction on the operation of movable contact 4 is reduced, so that a more excellent feeling can be obtained.

This embodiment describes an occasion in which case 11 has a material property and a color tone that absorb laser, but an occasion in which only the upper surface of wall part 11A of case 11 has a material property and a color tone that absorb laser may be employed. Alternatively, at least the upper surface of wall part 11A of case 11 may be formed of the same material as that of protective sheet 15. Furthermore, for example, coating may be applied to the upper surface of wall part 11A so as to absorb laser and to be melted. The same is true to pressing member 17.

This embodiment describes an example in which pressing member 17 is disposed in the concave portion, but pressing member 17 may not be provided. Protective sheet 15 is only required to be welded to case 11 at first welding place 21. Furthermore, instead of disposing pressing member 17 in case 11, the pressing member may be stuck to the position at the upper surface side of protective sheet 15 corresponding to the center part of movable contact 4.

Figure 5:
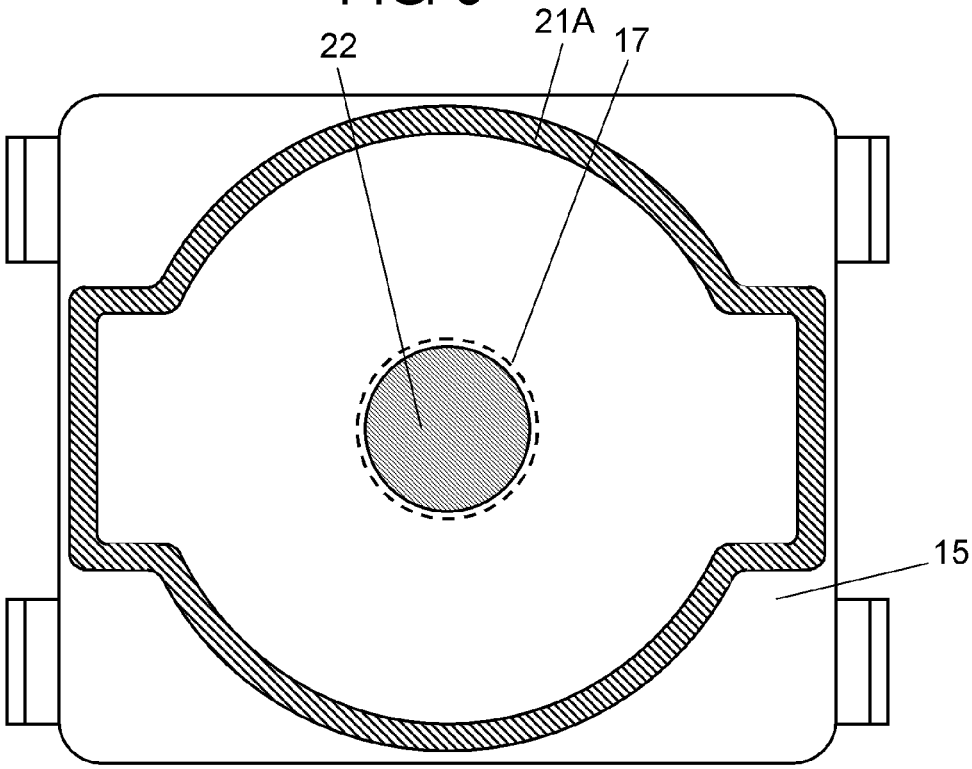
FIG. 5 is a top view of still another push switch in accordance with the embodiment of the present invention.
Figure 6:
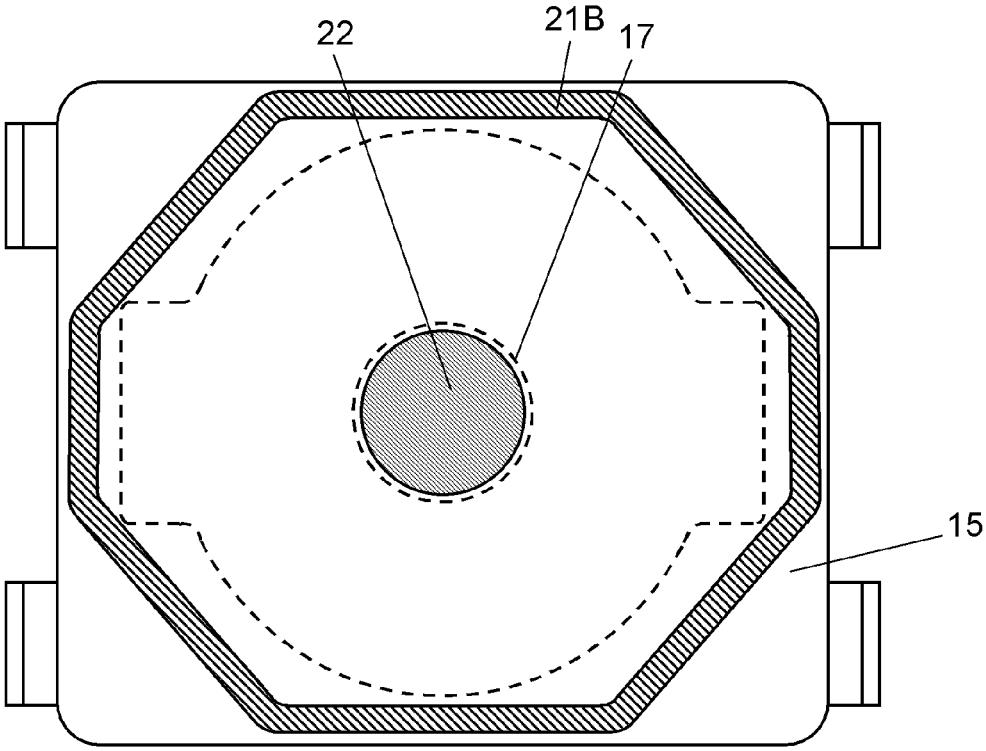
FIG. 6 is a top view of yet another push switch in accordance with the embodiment of the present invention.

Furthermore, the shape of first welding place 21 seen from the upper surface of protective sheet 15 is not limited to the rectangular shape mentioned above. For example, as shown in FIG. 5, first welding place 21A may be provided in a ring shape surrounding the periphery of the concave portion along the concave shape in case 11. That is to say, first welding place 21A may be formed along the inner periphery of the upper surface of wall part 11A. Furthermore, as shown in FIG. 6, first welding place 21B may be provided so as to surround the periphery of the concave portion in case 11 in a polygonal shape, and may be provided in a circular shape. Furthermore, it is preferable that first welding place 21, 21A, 21B is a continuous place from the viewpoint of strength, but it may be a partially opened linear shape. That is to say, first welding place 21, 21A, 21B may include a place that is not welded in part. Furthermore, first welding place 21, 21A, 21B may be welded over the entire surface of the upper surface of wall part 11A. In this way, the shape of the welding place and the dimension of the line width are set by considering the properties, the control aspect, and the like, comprehensively.

Furthermore, in this embodiment, welding of first welding place 21, 21A, 21B and welding of second welding place 22 are carried out by laser irradiation, but welding is not necessarily limited to laser irradiation. Welding may be carried out by using heat, ultrasonic waves, high frequency, or the like. However, it is preferable to use laser irradiation because the number of steps can be reduced and push switches having stable quality can be provided at a low cost.

Note here that a switch contact part is not necessarily limited to the above-mentioned switch contact part. For example, two independent fixed contacts, which are not always brought into contact with a movable contact, may be brought into contact with and separated from each other by way of the movable contact. Alternatively, a click feeling may not be generated at the time of operation. Furthermore, a switch may be a two-stage operation type switch, or a push-off type switch.

Furthermore, also as case 11, in addition to case 11 entirely formed of an insulating resin, for example, case 11 including a printed wiring board on the bottom portion and an insulating resin layer on the upper surface thereof.

According to this embodiment, since protective sheet 15 is strongly welded to case 11 by laser irradiation, even if a contact area between protective sheet 15 and case 11 becomes smaller, protective sheet 15 is stably held on case 11. Furthermore, since a welding place by laser irradiation is small, an effect on the other components is small, and thus a high quality push switch can be obtained. In addition, unlike conventional products, since it is not necessary to form an adhesive layer on protective sheet 15, the number of steps for mounting protective sheet 15 on case 11 can be reduced.

Furthermore, since the center portion of movable contact 4 is always pressed by pressing member 17, protective sheet 15 to which pressing member 17 is stuck is stably held on case 11. Therefore, an excellent operation feeling can be obtained for a long time.

Furthermore, by provisionally fixing pressing member 17 with respect to movable contact 4, pressing member 17 can be disposed on movable contact 4 with high accuracy.

A push switch in this embodiment has characteristics that even if a contact area between protective sheet 15 and case 11 becomes smaller, protective sheet 15 is stably held on case 11, and therefore, it is useful for input operation units and the like of various electronic apparatuses.

What is claimed is:

1. A push switch comprising:

a switch contact part for carrying out electrical connection by pressing, a case having a wall part on a periphery thereof and accommodating the switch contact part in a concave portion surrounded by the wall part; and a protective sheet covering the concave portion, wherein the protective sheet and at least a part of an upper surface of the wall part of the case are welded together as a first welding place, the switch contact part comprises a dome-shaped movable contact, a pressing member is located between the protective sheet and a center portion of the movable contact, and the protective sheet and the pressing member are welded to each other by a second welding place provided between the protective sheet and the pressing member.

2. The push switch of claim 1, wherein the second welding place is welded by laser irradiation.

3. The push switch of claim 1, wherein the first welding place is formed along an outer periphery of the upper surface of the wall part.

4. The push switch of claim 1, wherein the first welding place is formed along an inner periphery of the upper surface of the wall part.

5. The push switch of claim 1, wherein the first welding place has a closed shape seen from an outer side of the protective sheet.

6. The push switch of claim 1, wherein an outer shape of the first welding place is a rectangular shape seen from an outer side of the protective sheet.

7. The push switch of claim 1, wherein an outer shape of the first welding place is a polygonal shape seen from an outer side of the protective sheet.

8. The push switch of claim 1, wherein an outer shape of the first welding place has a circular shape seen from an outer side of the protective sheet.

9. The push switch of claim 1, wherein the first welding place is welded by laser irradiation.

10. The push switch of claim 1, wherein at least an upper surface of the wall part of the case is formed of a same material as a material of the protective sheet.

* * * * *